US007614536B2

(12) United States Patent
Shtylman

(10) Patent No.: US 7,614,536 B2
(45) Date of Patent: Nov. 10, 2009

(54) SYSTEM FOR INSTALLING FLOOR BOARDS

(76) Inventor: Vadim Z. Shtylman, 3375 Waters Mill Dr., Alpharetta, GA (US) 30022

( * ) Notice: Subject to any disclaimer, the term of this patent is extended or adjusted under 35 U.S.C. 154(b) by 7 days.

(21) Appl. No.: 11/936,998

(22) Filed: Nov. 8, 2007

(65) Prior Publication Data

US 2008/0110954 A1 May 15, 2008

Related U.S. Application Data

(60) Provisional application No. 60/858,139, filed on Nov. 9, 2006.

(51) Int. Cl.
*B25C 1/02* (2006.01)
*B25C 1/04* (2006.01)

(52) U.S. Cl. ..... 227/107; 227/99; 227/111; 227/148

(58) Field of Classification Search ..... 227/8, 227/28, 16, 99, 111, 148, 140, 107; 52/749.1, 52/745.17; 29/432, 525.01, 711, 716, 721, 29/772, 787, 795, 798, 281.3
See application file for complete search history.

(56) References Cited

U.S. PATENT DOCUMENTS

| | | | | |
|---|---|---|---|---|
| 2,681,789 | A * | 6/1954 | Nichols | 254/29 R |
| 3,286,649 | A * | 11/1966 | Hughes | 104/17.1 |
| 3,306,176 | A * | 2/1967 | Myers | 355/91 |
| 3,619,895 | A * | 11/1971 | Thompson | 29/432 |
| 3,764,053 | A * | 10/1973 | Thompson | 227/111 |
| 6,269,996 | B1 | 8/2001 | McAllister | |
| 6,527,156 | B2 | 3/2003 | McAllister et al. | |
| 7,419,078 | B2 * | 9/2008 | Hamar | 227/111 |

* cited by examiner

*Primary Examiner*—Rinaldi I. Rada
*Assistant Examiner*—Nathaniel Chukwurah
(74) *Attorney, Agent, or Firm*—Sutherland Asbill & Brennan LLP

(57) ABSTRACT

A system may install a floor above a sub-floor surface, the floor having a board abutting adjacent boards. The system may include a lowering apparatus, a positioning apparatus, and a securing apparatus. The lowering apparatus may be adapted to receive the board and to lower the board to the floor. The positioning apparatus may be adapted to position the board in contact with one or more of the adjacent boards. The securing apparatus may be adapted to secure the board to the sub-floor surface.

21 Claims, 15 Drawing Sheets

SYSTEM FOR INSTALLING FLOOR BOARDS

CROSS-REFERENCE TO RELATED APPLICATIONS

This application claims priority to co-pending U.S. provisional application entitled "Hardwood Floor Installer," filed on Nov. 9, 2006 and accorded U.S. Ser. No. 60/858,139, which is incorporated herein by reference in its entirety.

TECHNICAL FIELD

The present application generally relates to a system for installing boards and more particularly relates to a system for installing floor boards on a floor.

BACKGROUND

Hardwood floors are commonly found in homes and in other interior spaces. A typical hardwood floor may be formed from a number of individual floor boards positioned over a sub-floor surface. Each of the floor boards may have a longitudinal groove running along one longitudinal edge, and a longitudinal tongue running along the other longitudinal edge. Each of the floor boards may also have a transverse groove running along one transverse edge, and a transverse tongue running along the other transverse edge. The grooves are sized and shaped to receive the corresponding tongues, so that each board can mate with longitudinally and transversely adjacent boards to form a continuous floor surface.

To install one of the floor boards, the floor board may be placed on the floor close to a longitudinally adjacent floor board and close to a transversely adjacent floor board. The floor board may be positioned with an end of the floor board in contact with an end of the transversely adjacent floor board and the groove of the floor board in contact with the tongue of the longitudinally adjacent floor board. A force may applied to push the groove of the floor board onto the tongue of the longitudinally adjacent floor board. For example, a rubber mallet or a cloth-covered hammer may be used to strike the board, so that the groove is driven over the tongue. Once the floor boards are properly positioned next to each other, nails may be used to secure the floor board to the sub-floor surface 106. Each nail may be driven through the tongue of the floor board at an angle, so that the nail pierces the tongue and extends through the floor board to the sub-floor surface.

Installing the hardwood floor may be physically demanding. For example, a hardwood floor installer may stand and kneel repeatedly during the installation process. Usually the floor boards are placed in a pile somewhere in the room, and each floor board is installed separately. The hardwood floor installer may kneel to position and secure the floor boards on the sub-floor surface 106, may stand to retrieve additional floor boards from the pile, and may kneel again to position and secure the floor boards. Once in the kneeling position, force may be applied at different points along the length of the floor board to push the floor board against the adjoining floor boards, and nails may be deployed at different points along the length of the floor board to secure the tongue of the floor board to the sub-floor surface 106. To accomplish these tasks, the hardwood floor installer may reposition himself laterally along the longitudinal length of the floor board, such as by sliding on his knees or by standing up and kneeling down again. Such physical movements may be uncomfortable or physically exhausting.

Nailing the floor boards together may require skill and experience. Typically, the nail is driven into the floor board at an angle, so that the act of installing the nail further forces the floor board against the longitudinally adjacent floor board. To facilitate the nailing process, a floor board nailer may be employed. An embodiment of a prior art floor board nailer 10 is shown in FIG. 1. The floor board nailer 10 may have an activating button 12 positioned at an angle on a casing, and the floor installer may strike the activating button 12 with a mallet to activate the nailer 10. Due to the orientation of the button 12 on the casing, the striking force may be directed at an angle that further forces the floor boards together. In some cases, the floor board nailer 10 may be manually operated, while in other cases the floor board nailer 10 may be pneumatically assisted. Manually operated floor board nailers 10 may employ the striking force of the floor installer to engage a plunger that ejects the nail, while pneumatically-assisted nailers may employ the striking force to activate a pneumatic mechanism that ejects the nail. Examples of pneumatically-assisted floor board nailers may include the Hammerhead by Porta-Nails, Inc. of Wilmington, N.C., and the Bostitch Hardwood Flooring Cleat Nailer by the Stanley Works Corporation of New Britain, Conn.

Although the floor board nailer 10 may facilitate installing the nail, the floor board nailer 10 may otherwise be cumbersome to use. For example, repeatedly striking the activating button 12 may be physically tiresome. Also, laterally repositioning the floor board nailer 10 may require movements that are uncomfortable for the floor installer, such as repeatedly standing up and kneeling down, sliding laterally on the knees, or standing and bending at the waist. From the above, a need exists in the industry for a system that addresses these issues.

SUMMARY

A system may install a floor above a sub-floor surface, the floor having a board abutting adjacent boards. The system may include a lowering apparatus, a positioning apparatus, and a securing apparatus. The lowering apparatus may be adapted to receive the board and to lower the board to the floor. The positioning apparatus may be adapted to position the board in contact with one or more of the adjacent boards. The securing apparatus may be adapted to secure the board to the sub-floor surface.

The lowering apparatus may include an actuator, a retaining member, and one or more linkages. The retaining member may be sized and shaped to receive the board and to limit movement of the board in a vertical direction. The one or more linkages may operatively couple the actuator to the retaining member. The one or more linkages may transfer movement of the actuator to the retaining member to raise and lower the retaining member. The retaining member may include an access opening and one or more holding brackets. The access opening may be sized and shaped to permit inserting the board into the retaining member. The one or more holding brackets may be sized and shaped to limit movement of the board in the vertical direction.

The positioning apparatus may include a trigger and at least one positioning component. The at least one positioning component may be operatively coupled to the trigger. The at least one positioning component may apply a force to the board in response to engagement of the trigger. The at least one positioning component may include a positioning plate. The positioning plate may rotate into contact with the board in response to engagement of the trigger. An air hammer may apply a vibrational force to the positioning plate in response to engagement of a button.

The positioning apparatus may include a crank, at least one linkage, and a positioning plate. The at least one linkage may operatively couple to the crank, the linkage rotating in plane that is substantially parallel to the floor in response to rotation of the crank. The positioning plate may be positioned on the linkage, the linkage transferring rotation of the crank to the positioning plate so that the positioning plate contacts and applies a force to the board.

The securing apparatus may include an activator and a floor board fastening device. The floor board fastening device may be operatively coupled to the activator. The floor board fastening device may eject a fastener in response to engagement of the activator. For example, the floor board fastening device may eject the fastener in response to an activating force upon a button of the floor board fastening device, in which case the system may further include a mallet head, a transfer assembly, and a cylinder. The mallet head may be positioned to apply the activating force to the button when the mallet head is released from a raised position. The transfer assembly may be configured to grasp the mallet head when the transfer assembly is lowered and to raise the mallet head when the transfer assembly is raised. The cylinder may be associated with the activator and the transfer assembly. The cylinder may respond to engagement of the activator by lowering and raising the transfer assembly, causing the transfer assembly to grasp and raise the mallet head such that the mallet head can descend to apply the activating force on the button.

The system may include an air compressor. One or more of the lowering apparatus, the positioning apparatus, and the securing apparatus may be pneumatically powered using the air compressor.

In embodiments, a system for installing a board on a surface may include a positioning plate, a trigger, a fastening device, and an activator. The positioning plate may be positioned proximate to the surface. The trigger may be operatively coupled to the positioning plate by at least one linkage. The trigger may cause the linkage to move the positioning plate into contact with the board. The fastening device may be positioned proximate to the surface. The activator may be operatively coupled to the fastening device. The activator may cause the fastening device to eject a fastener into the board.

The trigger may be a crank that rotates about a pivot point in a plane substantially parallel to the surface. The positioning plate may be positioned on the linkage spaced apart from the pivot point of the crank. The linkage may transfer rotation of the crank to the positioning plate.

The fastening device may be a floor board nailer that ejects a nail in response to an activating force upon an activating button. The activator may cause a mallet head to apply the activating force to the activating button.

The system may include a holder, an actuator, and one or more linkages. The holder may be sized and shaped to receive the floor board and to limit movement of the floor board in a vertical direction. The actuator may be movable between a first position and a second position. The one or more linkages may operatively connect the actuator to the holder. The one or more linkages may raise and lower the holder in response to movement of the actuator between the first position and the second position.

In embodiments, a system may be operated by a standing user to install a floor board on a floor. The system may include a retaining member, a positioning plate, and a fastening device. The retaining member may receive the floor board and may be lowered to the floor in response to the standing user engaging a first trigger. The positioning plate may contact and apply a force to the floor board in response to the standing user engaging a second trigger. The fastening device may eject a fastener through the floor board in response to the standing user engaging a third trigger.

The first trigger may be a first crank. The first crank may cause a first linkage to move the retaining member. The second trigger may be a second crank. The second crank may cause a second linkage to rotate the positioning plate. The third trigger may be a button. The button may cause a mallet head to apply an activating force to the fastening device.

The system may include a movable cart. The movable cart may be associated with the retaining member, the positioning plate, the fastening device, and each of the triggers, such that moving the movable cart simultaneously repositions substantially the entire system.

The retaining member may be associated with the movable cart via a series of linkages. The linkages may raise and lower the retaining member in response to the user engaging the first trigger. The retaining member may be accessible to the standing user when raised and may be proximate to the floor when lowered. The first trigger may be associated with the movable cart at a height accessible to the standing user, such the when the standing user operates the first trigger at the accessible height, the linkages raise and lower the retaining member.

The positioning plate may be associated with the movable cart adjacent to the floor. The second trigger may be associated with the movable cart at an accessible height for the standing user, such that when the standing user operates the second trigger at the accessible height, the positioning plate is moved adjacent to the floor.

The fastening device may be associated with the movable cart adjacent to the floor. The third trigger may be associated with the movable cart at an accessible height for the standing user, such that when the standing user operates the third trigger at the accessible height, the fastening device ejects the fastener adjacent to the floor.

The system may also include a fourth trigger operatively coupled to the fastening device. The fourth trigger may cause the fastening device to move out of contact with the floor and into contact with the floor.

In embodiments, a system for lowering and fastening an object to a surface may include a movable holder, a first actuator, a positioning plate, a second actuator, a fastening device, and an activator. The movable holder may be sized and shaped to receive the object. The first actuator may raise and lower the holder. The positioning plate may be positioned proximate to the surface. The second actuator may rotate the positioning plate in a plane substantially parallel to the surface. The fastening device may eject a fastener. The activator may cause the fastening device to eject the fastener.

Other systems, devices, methods, features, and advantages of the disclosed system for installing floor boards will be apparent or will become apparent to one with skill in the art upon examination of the following figures and detailed description. All such additional systems, devices, methods, features, and advantages are intended to be included within the description and are intended to be protected by the accompanying claims.

BRIEF DESCRIPTION OF THE FIGURES

The present disclosure may be better understood with reference to the following figures. Matching reference numerals designate corresponding parts throughout the figures, and components in the figures are not necessarily to scale.

DETAILED DESCRIPTION

Described below are embodiments of a system for installing floor boards on the floor. The system may be operated by a user in a standing position. The user may place a floor board into the system and may operate the system to install the floor board on the floor. Specifically, the user may operate the system to lower the floor board onto the floor, position the floor board in contact with adjacent floor boards, and secure the floor boards together. The user may then reposition the system, place another floor board into the system, and operate the system to install another floor board on the floor. Such a system may permit the user to remain in the standing position as the floor boards are installed.

Figure 1:
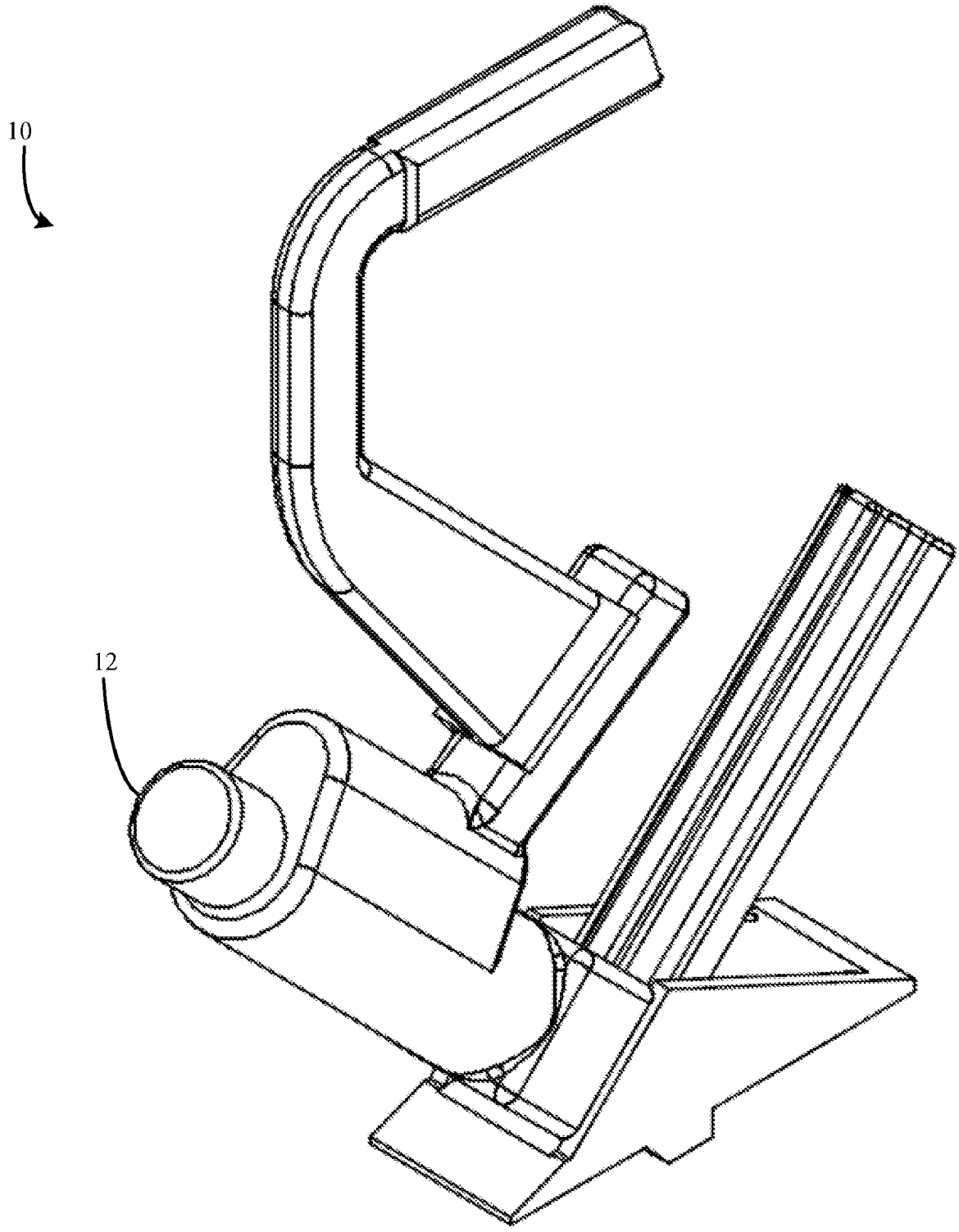
FIG. 1 (PRIOR ART)
FIG. 1 is a perspective view of an embodiment of a prior art floor board nailer.
Figure 2:
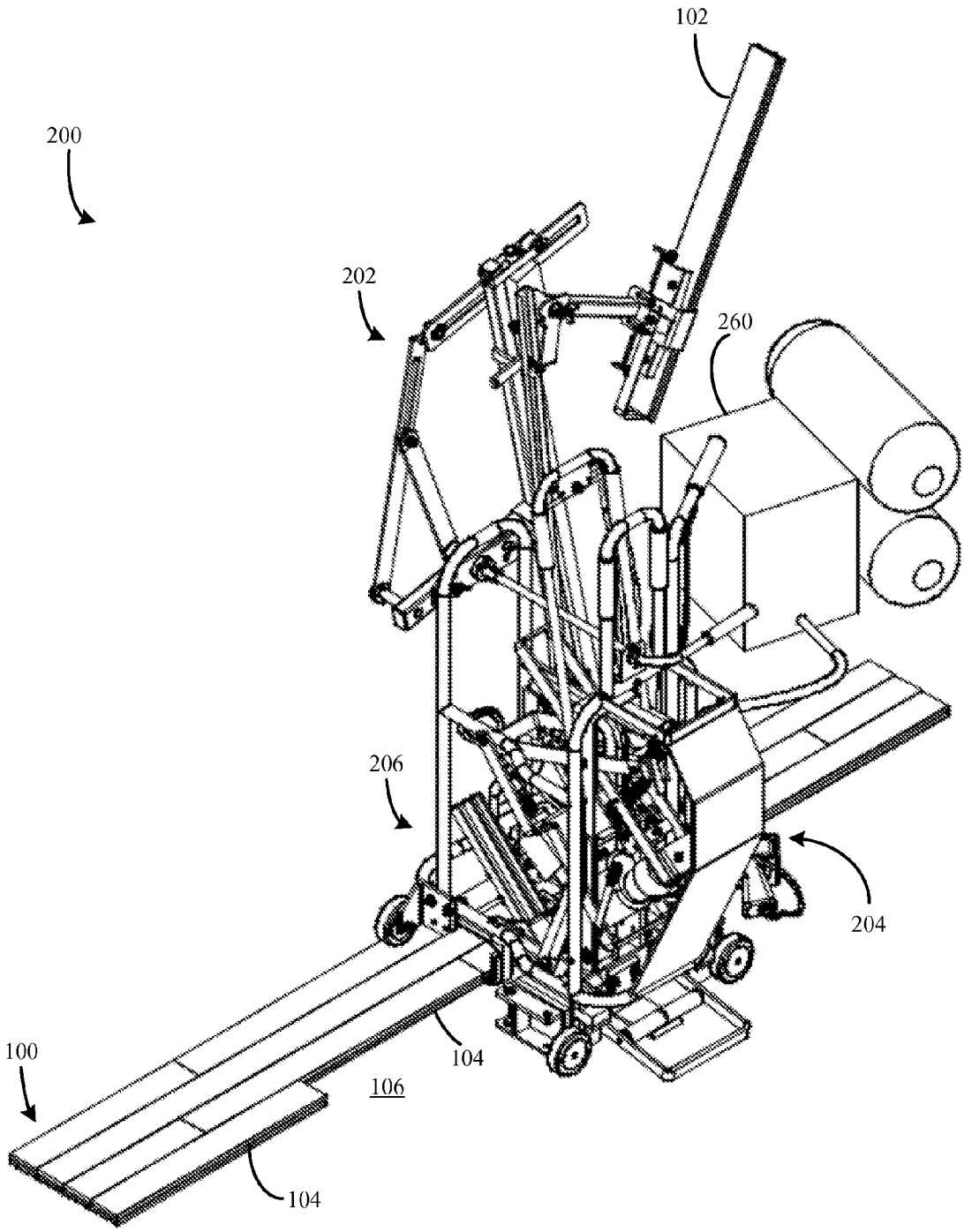
FIG. 2 is a front perspective view of an embodiment of a system for installing floor boards, illustrating the system positioned over a floor and associated with an air compressor.
Figure 3:
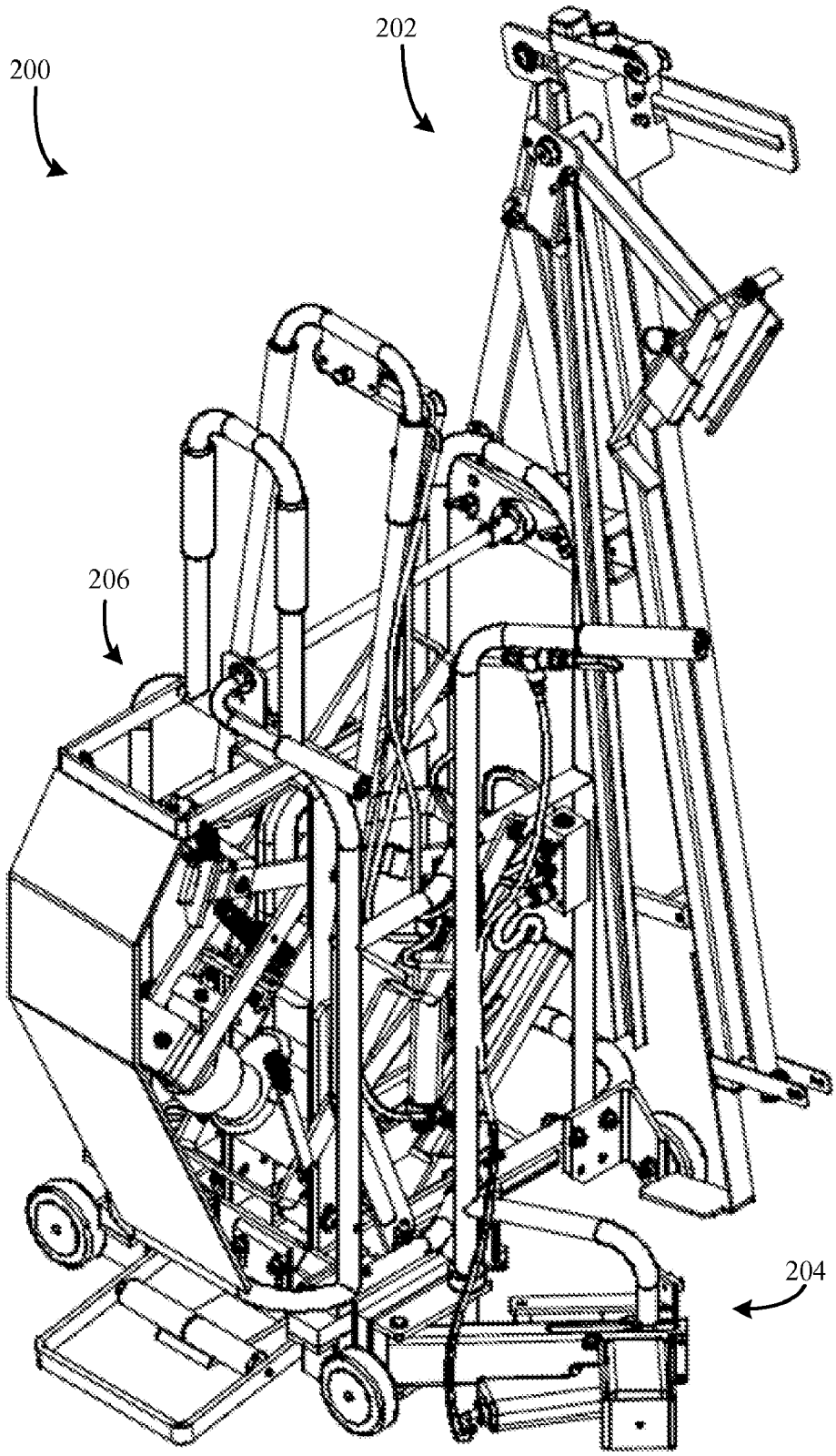
FIG. 3 is another front perspective view of the system shown in FIG. 2.
Figure 4:
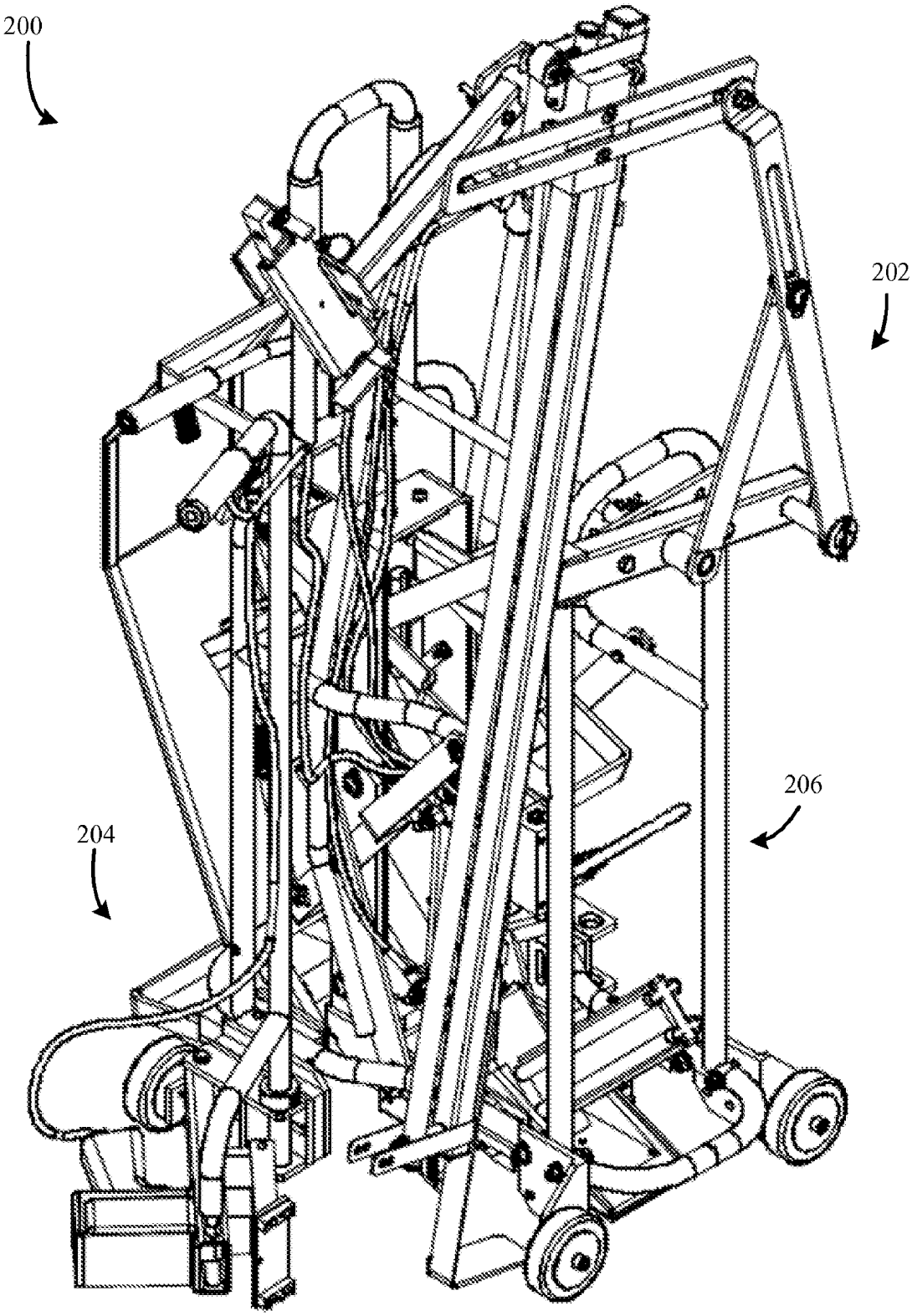
FIG. 4 is a rear perspective view of the system shown in FIG. 2.

FIG. 2 is a front perspective view of an embodiment of a system 200 for installing floor boards, illustrating the system positioned over a floor and associated with an air compressor. FIGS. 3 and 4 are front and rear perspective views of the system 200 for installing floor boards. As shown, the system 200 generally may include a lowering mechanism 202, a positioning mechanism 204, and a securing mechanism 206. The lowering mechanism 202 may receive the board 102 and may lower the board 102 onto the floor 100. Once the board 102 is on the floor 100, the positioning mechanism 204 may position the board 102 in contact with adjacent boards 104. The securing mechanism 206 then may secure the board to a sub-floor surface 106 below the board 102.

Figure 5:
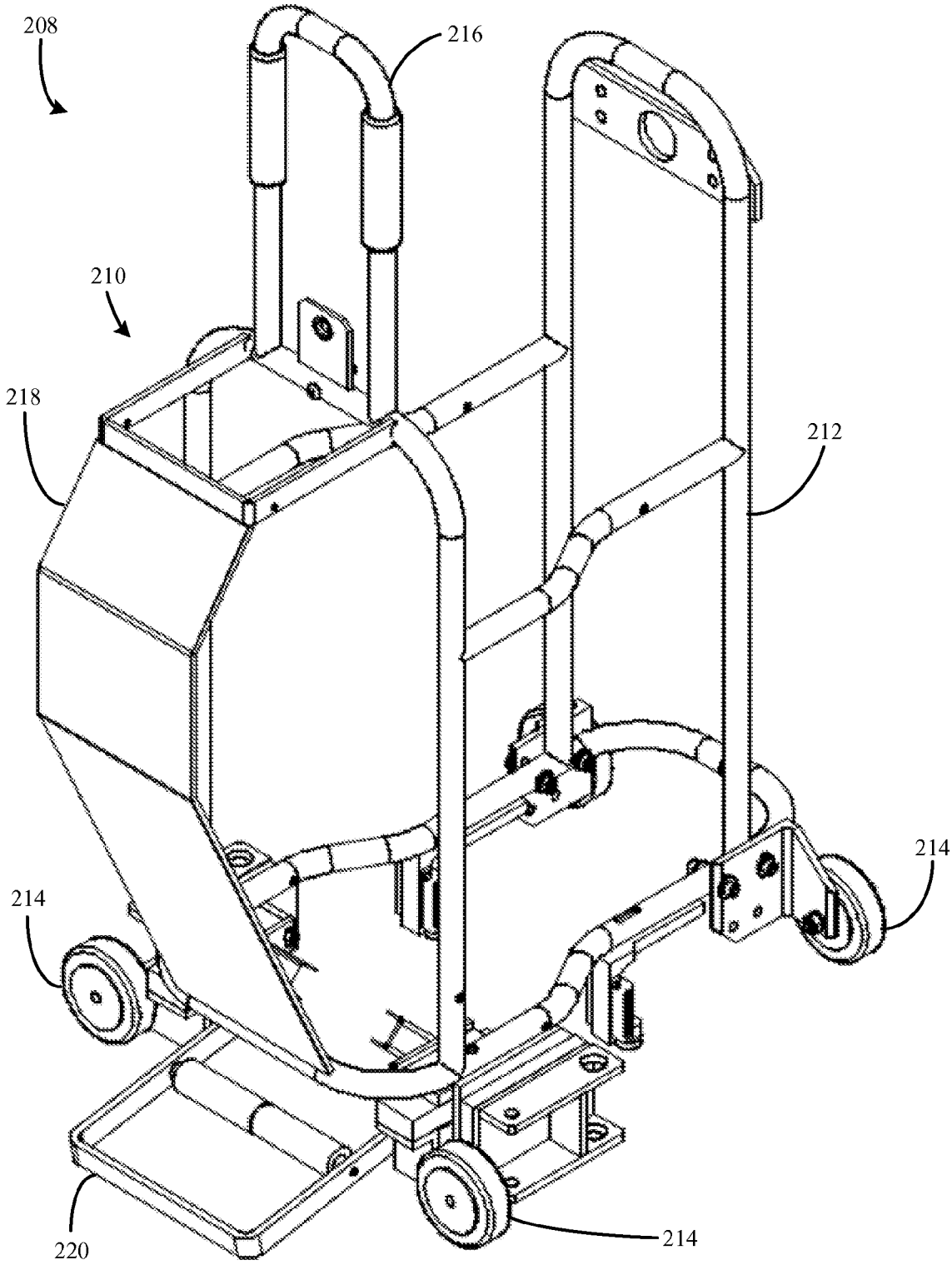
FIG. 5 is a front perspective view of the system shown in FIG. 2, illustrating a supporting mechanism of the system with the other components of the system removed.
Figure 6:
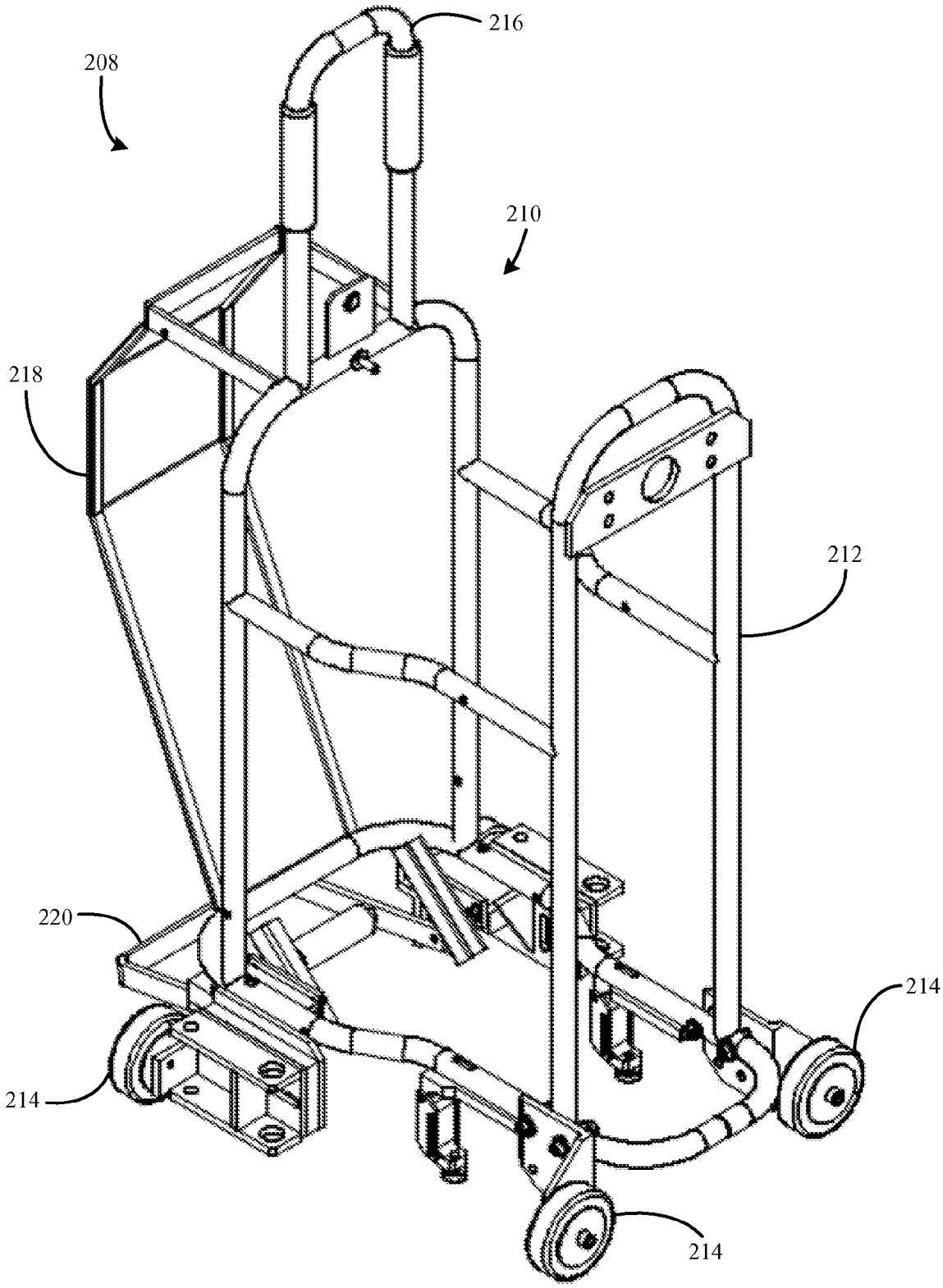
FIG. 6 is a rear perspective view of the system shown in FIG. 2, illustrating the supporting mechanism of the system with the other components of the system removed.

Each of the lowering mechanism 202, the positioning mechanism 204, and the securing mechanism 206 may be associated with a support mechanism 208. A suitable embodiment of the support mechanism 208 is shown in FIGS. 5 and 6, although other configurations are possible. The components of the system 200 may be mounted to the support mechanism 208, so that substantially the entire system 200 may be repositioned by moving the support mechanism 208. As shown, the support mechanism 208 may be a cart 210 having a frame 212 positioned on a number of transport members 214. The transport members 214 may be wheels or casters, among others. Each of the lowering mechanism 202, the positioning mechanism 204, and the securing mechanism 206 may be mounted to the frame 212, so that each of these mechanisms may be moved in unison. The cart 210 may also include a handle 216, a shield 218, and a pedal 220. The handle 216 may extend from the frame 212 at a comfortable height for the user to grasp while operating the system 200. The shield 218 and the pedal 220 are described in further detail below in connection with FIGS. 14 and 15.

Figure 7:
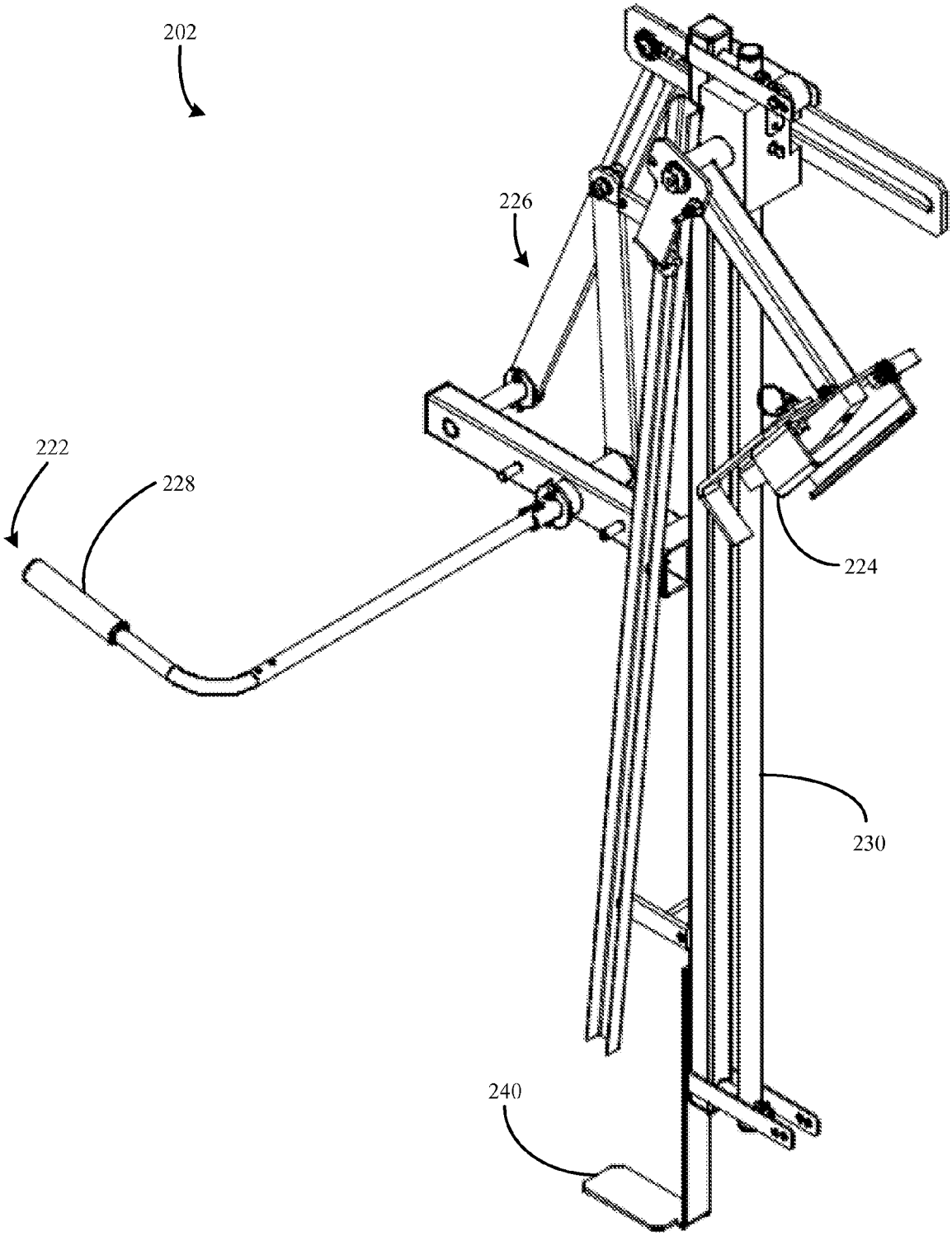
FIG. 7 is a front perspective view of the system shown in FIG. 2, illustrating a lowering mechanism of the system with the other components of the system removed.
Figure 8:
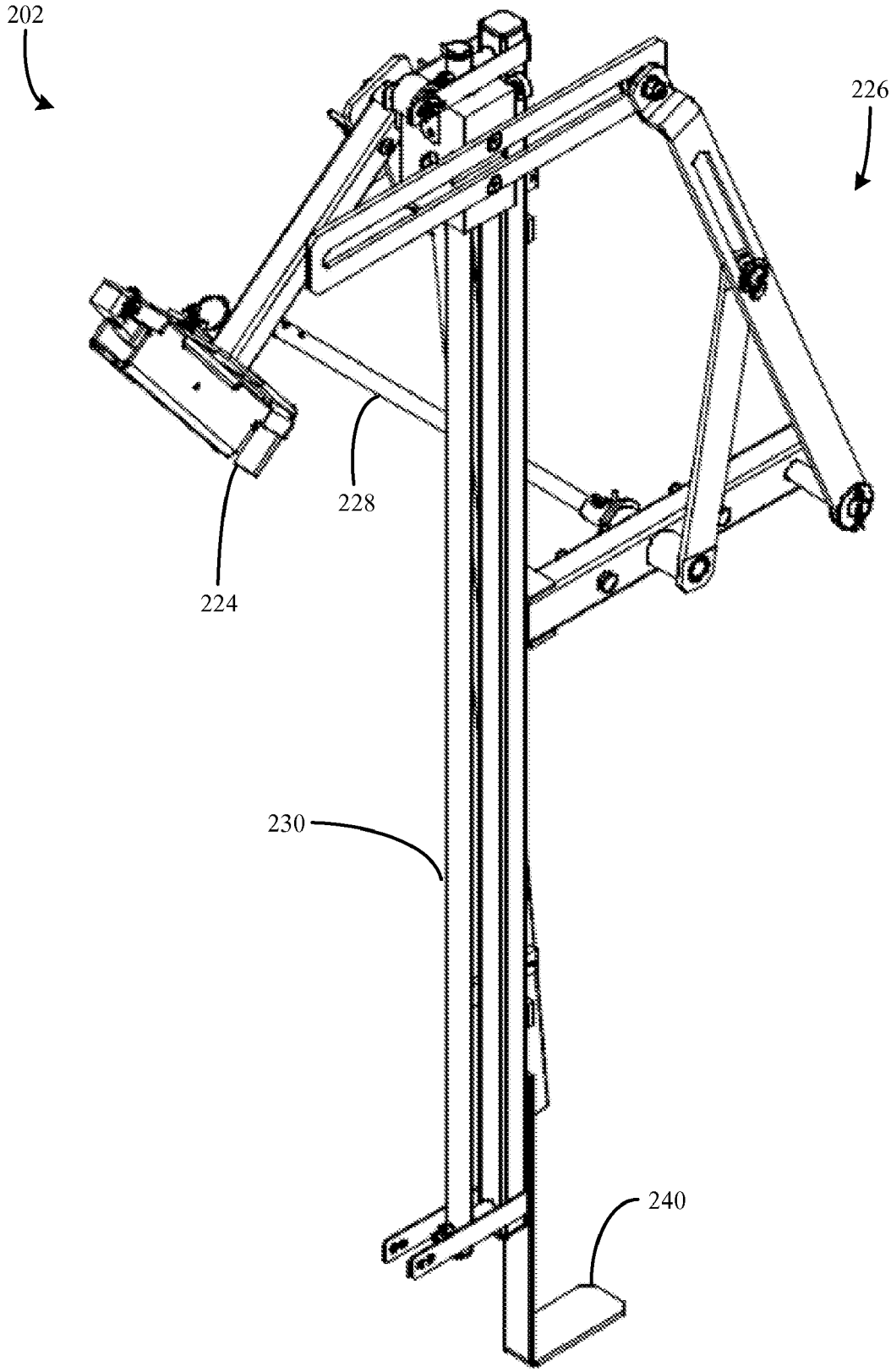
FIG. 8 is a rear perspective view of the system shown in FIG. 2, illustrating the lowering mechanism of the system with the other components of the system removed.

As mentioned, the system 200 may include the lowering mechanism 202, which may receive the board 102 and may lower the board to the floor 100. An embodiment of the lowering mechanism 202 is shown in FIGS. 7 and 8. As shown, the lowering mechanism 202 may include an actuator 222 operatively coupled to a retaining member 224 by one or more linkages 226. The actuator 222 may be movable between a first position and a second position. For example, the actuator 222 may be a crank 228 that can be rotated by the user, although other configurations are possible. The linkages 226 may transfer movement of the actuator 222 to the retaining member 224. Specifically, the linkages 226 may cause the retaining member 224 to move between a raised position and a lowered position. The retaining member 224 may move along a track 230, although the track 230 may be omitted.

The board 102 may be received by the retaining member 224 and may be generally retained by the retaining member 224 as the retaining member 224 moves. Specifically, the retaining member 224 may limit the movement of the board 102 relative to the retaining member 224 in at least the vertical direction. Thus, when the actuator 222 is engaged, the linkages 226 may respond by lowering the retaining member 224 to the floor 100. Thus, the board 102 may be lowered to the floor 100.

The lowering mechanism 202 may be oriented on the support mechanism 208 so that the lowering mechanism 202 may be operated by a standing user. As shown in FIG. 2, the actuator 222 may be located at a height that is accessible by a standing user. Additionally, when the retaining member 224 is in the raised position, the retaining member 224 may be located at a height that is accessible by the standing user, so that the user may insert the board 102 into the retaining member 224. The retaining member 224 may also be oriented on the support mechanism 208 such that the board 102 may be deposited on the floor 100 in substantially the correct orientation without being damaged. For example, when the retaining member 224 is in the lowered position, the retaining member 224 may be located relatively proximate to the floor 100, so that the board 102 may be deposited on the floor without substantial free fall in the vertical direction. Additionally, the retaining member 224 may be oriented to deposit the board 102 in a direction that is substantially parallel to the adjacent floorboard.

Figure 9:
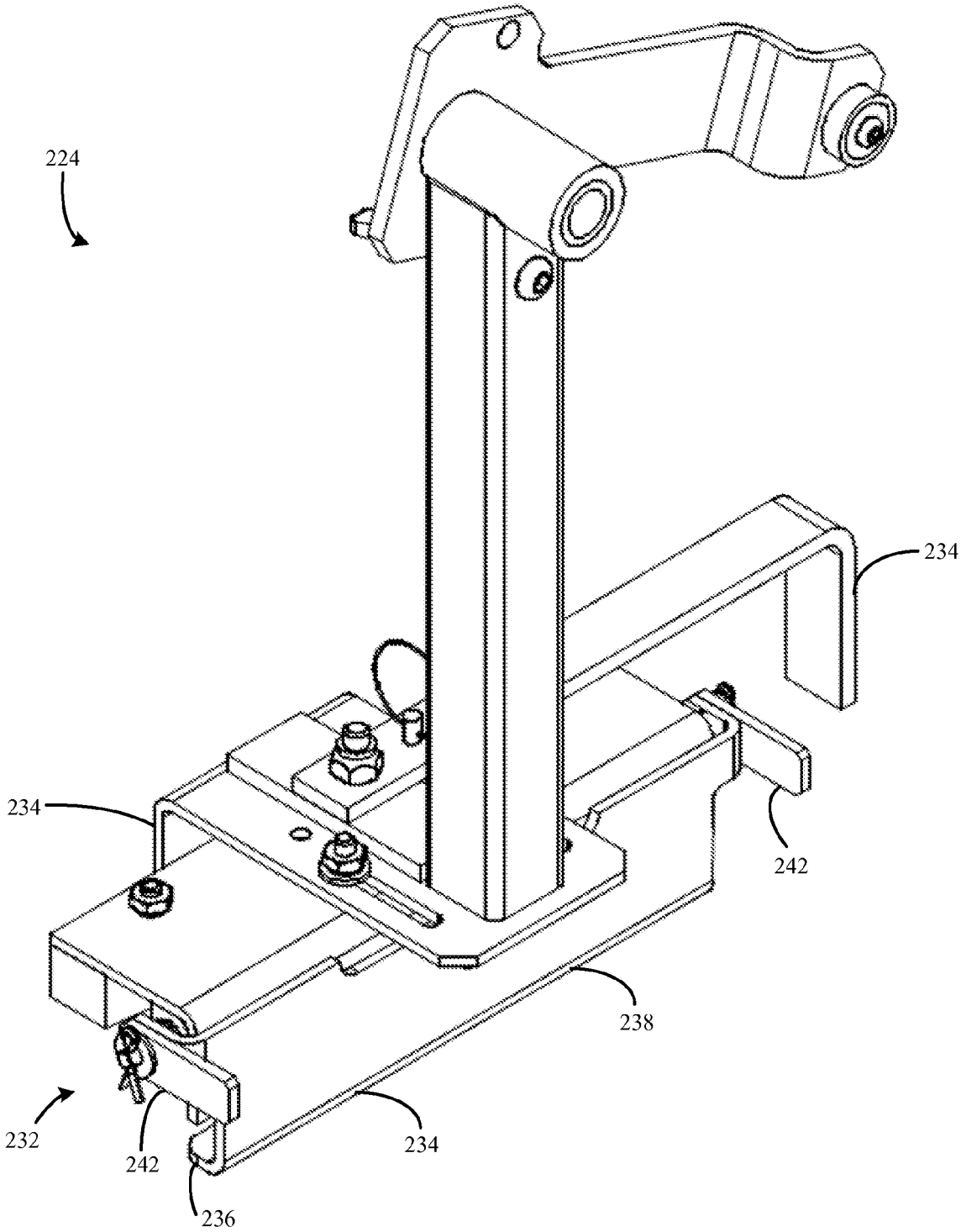
FIG. 9 is a partial perspective view of the lowering mechanism of FIG. 7, illustrating a retaining member of the lowering mechanism in greater detail.

FIG. 9 is a partial perspective view of the lowering mechanism 202, illustrating the retaining member 224 of the lowering mechanism 202 in greater detail. As shown, the retaining member 224 may include an access opening 232 and a number of holders 234. The access opening 232 may be sized and shaped to permit placing the board 102 in the retaining member 224. Each of the holders 234 may be sized and shaped to limit the movement of the board 102 in at least one direction. At least some of the holders 234 may limit the movement of the board 102 in the vertical direction. For example, a leg 236 of the holder 238 may be positioned underneath the board 102 to prevent the board 102 from falling. So that the board 102 can be released onto the floor 100 when the retaining member 224 is in the lowered position, the retaining member 224 may be releasable. As shown, at least one of the holders 234 may be a pivotable holder 238 that is pivotably coupled to the retaining member 224. A kick plate 240 may be positioned on the lowering mechanism 202 proximate to the floor 100 (FIGS. 7 and 8). As the retaining member 224 is lowered, one or more lever arms 242 on the pivotable holder 238 may engage the kick plate 240, and the pivotable holder 238 may pivot outward. Thus, the board 102 may be released by the retaining member 224. It should be noted that the illustrated embodiment of the lowering mechanism 202 is merely one example of a range of configurations that are included within the scope of the present disclosure.

Figure 10:
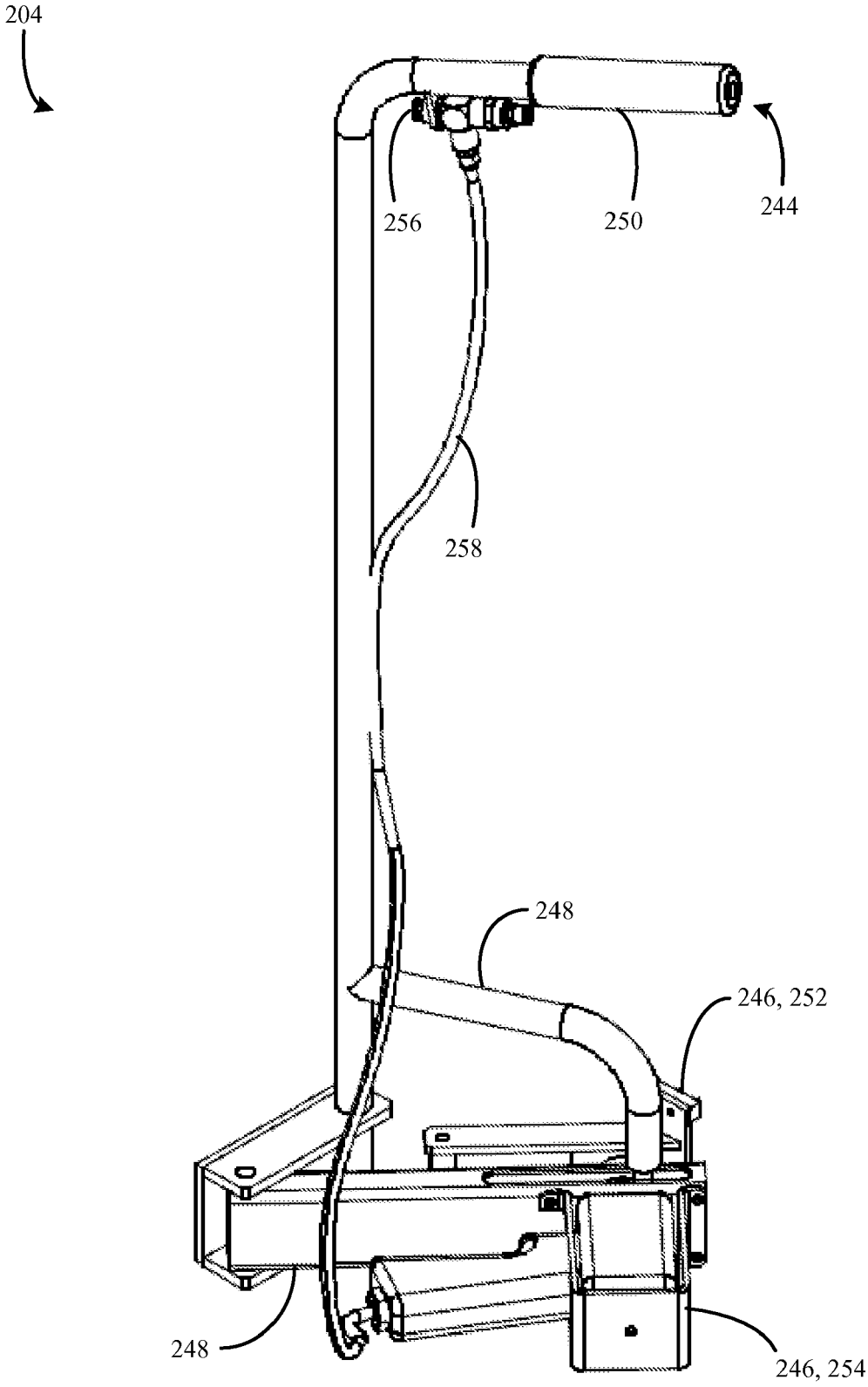
FIG. 10 is a front perspective view of the system shown in FIG. 2, illustrating a positioning mechanism of the system with the other components of the system removed.
Figure 11:
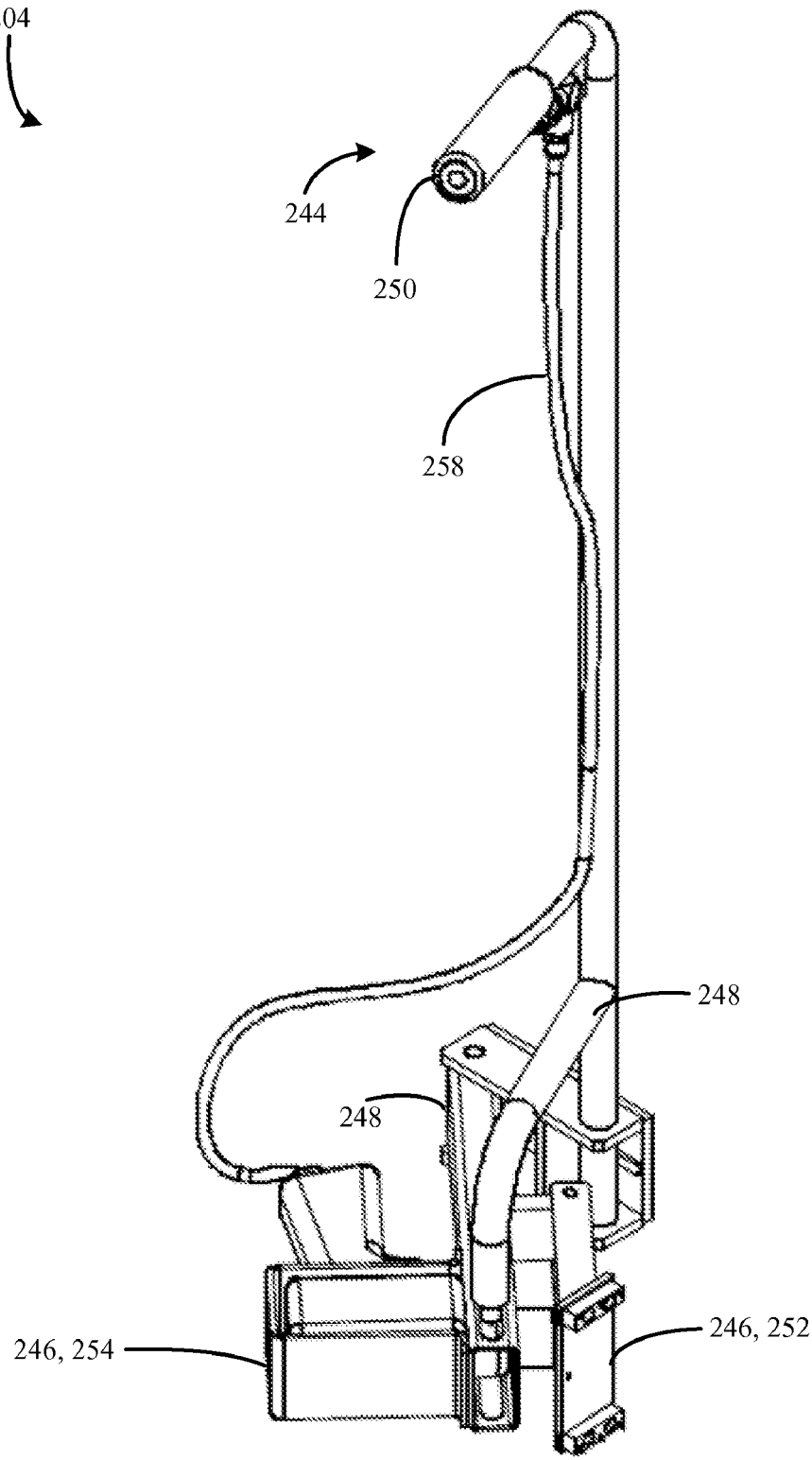
FIG. 11 is a side perspective view of the system shown in FIG. 2, illustrating the positioning mechanism of the system with the other components of the system removed.

Once the board 102 is on the floor 100, the positioning mechanism 204 may position the board 102 in contact with adjacent boards 104. An embodiment of a positioning mechanism 204 is shown in FIGS. 10 and 11. As shown, the positioning mechanism 204 may include at least one trigger 244 coupled to at least one positioning component 246 by at least one linkage 248. The trigger 244 may be located at a height that is accessible to a standing user, and the positioning component 246 may be positioned proximate to the floor 100. The trigger 244 may be engaged to operate the positioning component 246 via the linkage 248. The positioning component 246 may apply a force to the board 102, pushing the board 102 against at least one adjacent board 104. For example, the force may have a component in a direction that is substantially perpendicular to a longitudinal length of the board 102, so that the board 102 is pushed against the longitudinally adjacent board 104. The force may also have a component in a direction that is substantially parallel to the longitudinal length of the board 102, so that the board 102 is pushed against the transversely adjacent board 104. Thus, the board 102 may be repositioned by the user using the positioning component 246, so that the board 102 abuts or adjoins one or more of the adjacent boards 104.

Figure 12:
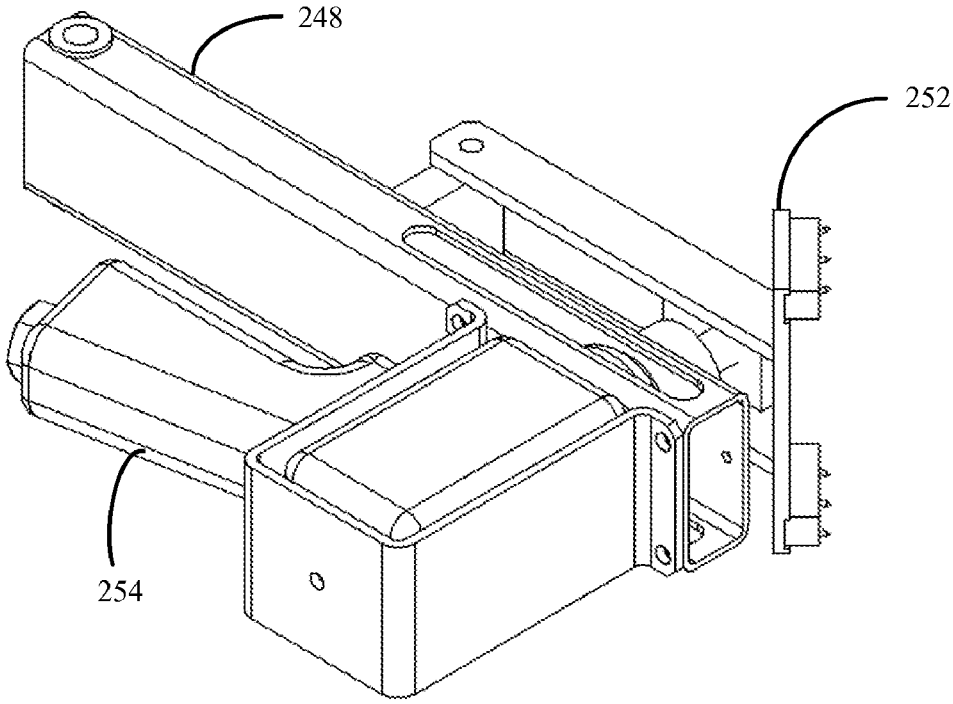
FIG. 12 is a partial perspective view of the positioning mechanism shown in FIG. 10, illustrating a positioning plate and an air hammer of the positioning mechanism in greater detail.
Figure 13:
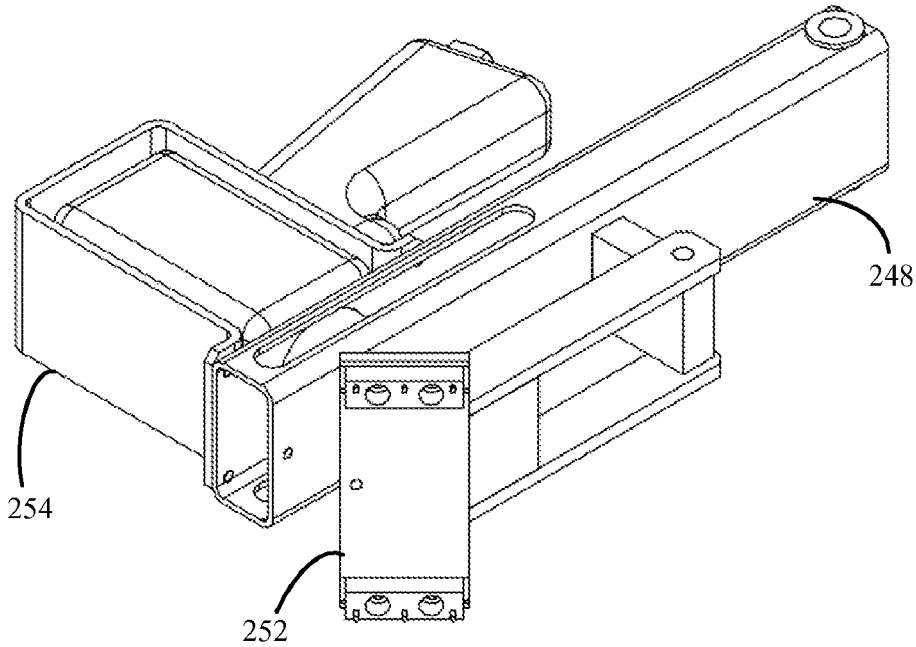
FIG. 13 is another partial perspective view of the positioning mechanism shown in FIG. 12, illustrating the positioning plate and the air hammer in greater detail.

As shown, the trigger 244 may be a crank 250 that may be rotated by the user, and the linkages 248 may transfer the rotation of the crank 250 to the positioning component 246. Further, the positioning component 246 may be a positioning plate 252, among others. In some cases, the positioning plate 252 may be associated with an air hammer 254. FIGS. 12 and 13 are partial perspective views of the positioning mechanism 204, illustrating an embodiment of the positioning plate 252 and an embodiment of the air hammer 254 in greater detail. The plate 252 may be spaced apart from the crank 250 by the linkages 248. When the user operates the crank 250, the linkages 248 may cause the plate 252 to rotate in a plane that is substantially parallel to the floor 100. The rotation may cause the plate 252 to contact and apply a force to the board 102. The plate 252 may move in a direction having at least a component that is substantially perpendicular to a longitudinal length of the board 102, so that the plate 252 may push the longitudinal edge of the board 102 against the longitudinally adjacent board 104. In some cases, the plate 252 may also move in a direction having a component that is substantially parallel to the longitudinal length of the board 102, so that the plate 252 may push the transverse edge of the board 102 against the transversely adjacent board 104. Thus, the board 102 may be repositioned by a user operating the crank 250.

In some embodiments, the positioning mechanism 204 may further include the air hammer 254. The air hammer 254 may be associated with a button 256 located, for example, on the crank 250. The button 256 may be connected to the air hammer 254 via a pneumatic tube 258, shown in FIG. 11, that communicates with an air compressor 260 shown in FIG. 2. When the user pushes the button 256, compressed air may travel from the air compressor 260 through the pneumatic tube 258 and to the air hammer 254. The air hammer 254 may apply a vibrational force to the positioning plate 252, causing the positioning plate 252 to reposition the board 102.

As shown in the illustrated embodiment, the air hammer 254 may be mounted to the linkages 248, so that rotating the crank 250 rotates the air hammer 254 in addition to the plate 252. While both the plate 252 and the air hammer 254 are shown in the illustrated embodiment, only one of these positioning components 246 or other positioning components 246 may be provided in other embodiments. Further, the trigger 244 may have a range of configurations. For example, the trigger 244 may be any mechanical actuator adapted for receiving mechanical movement that can be transferred to the linkages 248. Alternatively, the movement of the linkages 248 may be automated, in which case the trigger 244 may be a button or other actuator that can be engaged with relative ease. For example, movement of the linkages 248 may be pneumatically powered by the air compressor 260, in which case both the trigger 244 and the linkages 248 may be in communication with the air compressor 260. In still other cases, the linkages 248 may be omitted, in which case the trigger 244 may operate the positioning component 246 directly.

The illustrated system 200 may be used to install floor boards by working from a left side of an area to a right side of the area. Specifically, the system 200 may install boards 102 on a right side of the system 200. The lowering mechanism 202 may lower the board 102 on the right of the system 200, and the positioning mechanism 204 may position the board 102 on the right of the system 200. The board 102 may be secured, the system 200 may be moved to the right, and the next board 102 may be installed on the right side of the system 200. Although such a configuration is suited for some areas, other areas may be suited for working from the right side of the area to the left side of the area. Thus, the lowering mechanism 202 and the positioning mechanism 204 may be reversible in some embodiments. In other words, the lowering mechanism 202 and the positioning mechanism 204 may be disassociated from the support mechanism 208, reversed in orientation, and re-associated with the support mechanism 208 on an opposite lateral side of the support mechanism 208. Thus, the system 200 may be re-configured to install floor boards 102 by working from the right side of the area to the left side of the area, the boards 102 being installed on the left side of the system 200.

Figure 14:
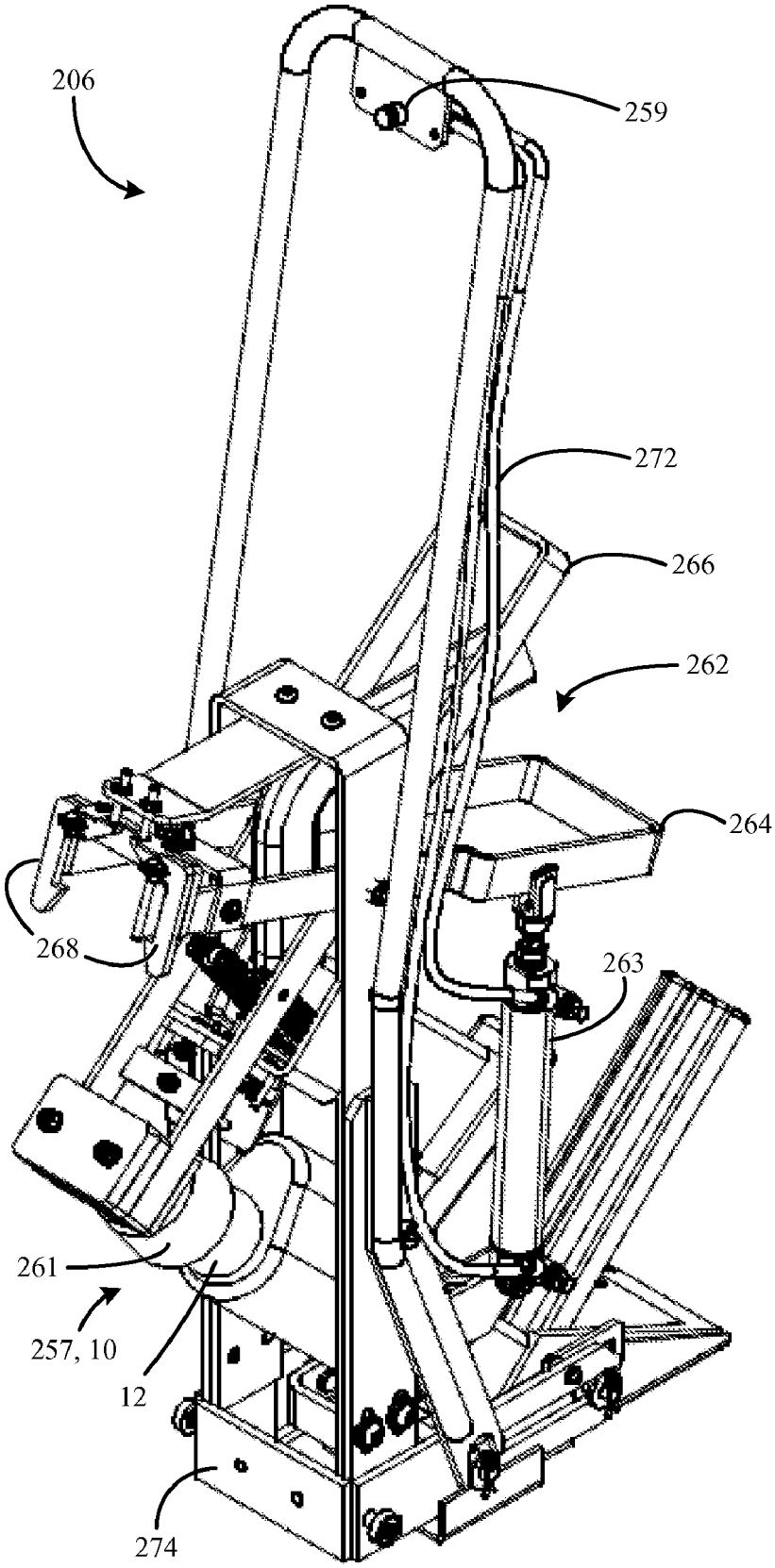
FIG. 14 is a front perspective view of the system shown in FIG. 2, illustrating a securing mechanism of the system with the other components of the system removed.
Figure 15:
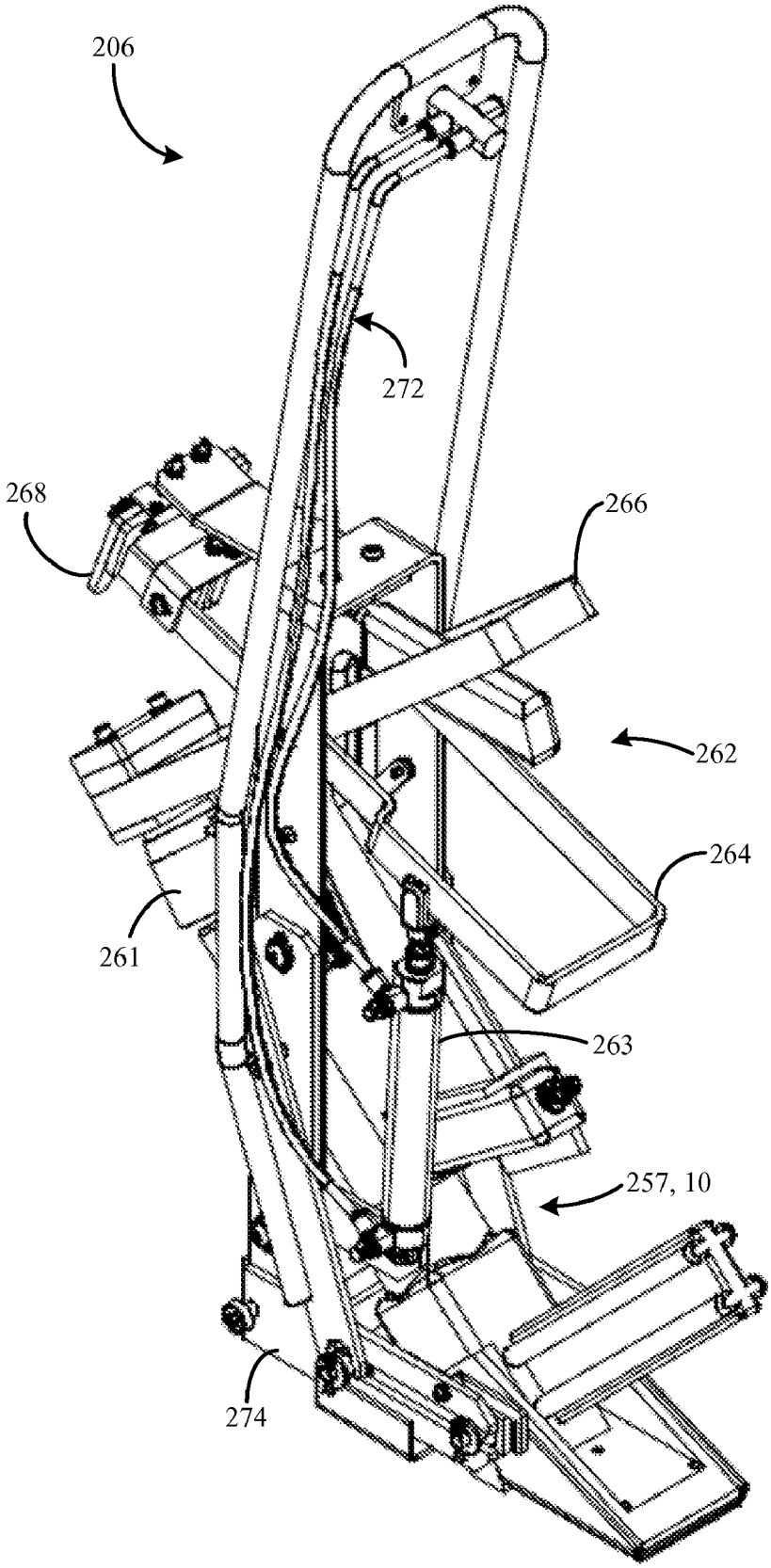
FIG. 15 is a rear perspective view of the system shown in FIG. 2, illustrating the securing mechanism of the system with the other components of the system removed.

Once the board 102 has been positioned in place, the securing mechanism 206 may be operated to secure the board 102 to the sub-floor surface 106. An embodiment of the securing mechanism 206 is shown in FIGS. 14 and 15. As shown, the securing mechanism 206 may include a fastening apparatus 257 associated with an activator 259. The activator 259 may be any device adapted for receiving an input from the user, such as a button or a lever, among others. The fastening apparatus 257 may be any device adapted to eject a fastener into the floor board 102. The fastening apparatus 257 may be positioned within the support mechanism 208 so as to contact the floor boards 102. The activator 259 may be located at a height that is accessible by the user, such as on a handle. The user may engage the activator 259, and in response, the fastening apparatus 257 may eject a fastener into the floor board 102.

As shown, the fastening apparatus 257 may be a floor board nailer 10 as described above. The floor board nailer 10 may include an activating button 12 positioned on a casing of the floor board nailer 10. The activating button 12 may be adapted to receive an activating force, and the floor board nailer 10 may eject a nail in response to the activating force upon the activating button 12. However, the fastening apparatus 257 may have other configurations. For example, a range of different nailers, staplers, or other fastening devices may be used.

In some cases, the securing mechanism 206 may further include a cylinder 263, a mallet head 261, and a transfer assembly 262. The cylinder 263 may be any type of cylinder, such as a pneumatic cylinder, among others. The transfer assembly 262 may be associated with the cylinder 263 and the mallet head 261. The mallet head 261 may be sized, shaped, and positioned within the support mechanism 208 to apply the activating force to the activating button 12 when released from an elevated position. When the activator 259 is operated, the cylinder 263 may cause the transfer assembly 262 to grasp the mallet head 261 and raise the mallet head 261 to the elevated position. When the mallet head 261 is released by the transfer assembly 262, the mallet head 261 may descend to apply the activating force on the activating button 12, causing the floor board nailer 10 to eject the nail into the floorboard 102.

As shown in the illustrated embodiment, the transfer assembly 262 may include two reciprocating arms 264, 266 coupled to a central pivot point. The reciprocating arms 264, 266 may include a transferring arm 264 and a receiving arm 266. The transferring arm 264 may have a rearward end that is associated with the cylinder 263 and a forward end that is associated with a pair of pivoting grippers 268. The rearward end may normally be in a lowered position and the forward end may normally be in a raised position. The receiving arm 266 may have a forward end that is associated with the mallet head 261 and a rearward end. The rearward end may normally be in a raised position and the forward end may normally be in a lowered position, such that the mallet head 261 rests on the activating button 12 of the floor board nailer 10. When the activator 259 is engaged, the cylinder 263 may raise the rearward end of the transferring arm 264. The transferring arm 264 may pivot about the central pivot point, lowering the forward end of the transferring arm 264. As the forward end of the transferring arm 264 descends, the pivoting grippers 268 may engage the mallet head 261, which is resting on the activating button 12. The mallet head 261 may force the pivoting grippers 268 outward and the pivoting grippers 268 may travel along sides of the mallet head 261. Once the forward end of the transferring arm 264 reaches the lowered position, the pivoting grippers 268 may pivot inward to become firmly positioned about the mallet head 261. The activator 259 then may be disengaged, which may cause the cylinder 263 to lower. In response, the rearward end of the transferring arm 264 may be lowered, and the forward end of the transferring arm 264 may be raised. Because the pivoting grippers 268 are firmly positioned about the mallet head 261, the forward end of the receiving arm 266 may also be raised, such that the mallet head 261 begins traveling upward.

Figure 16:
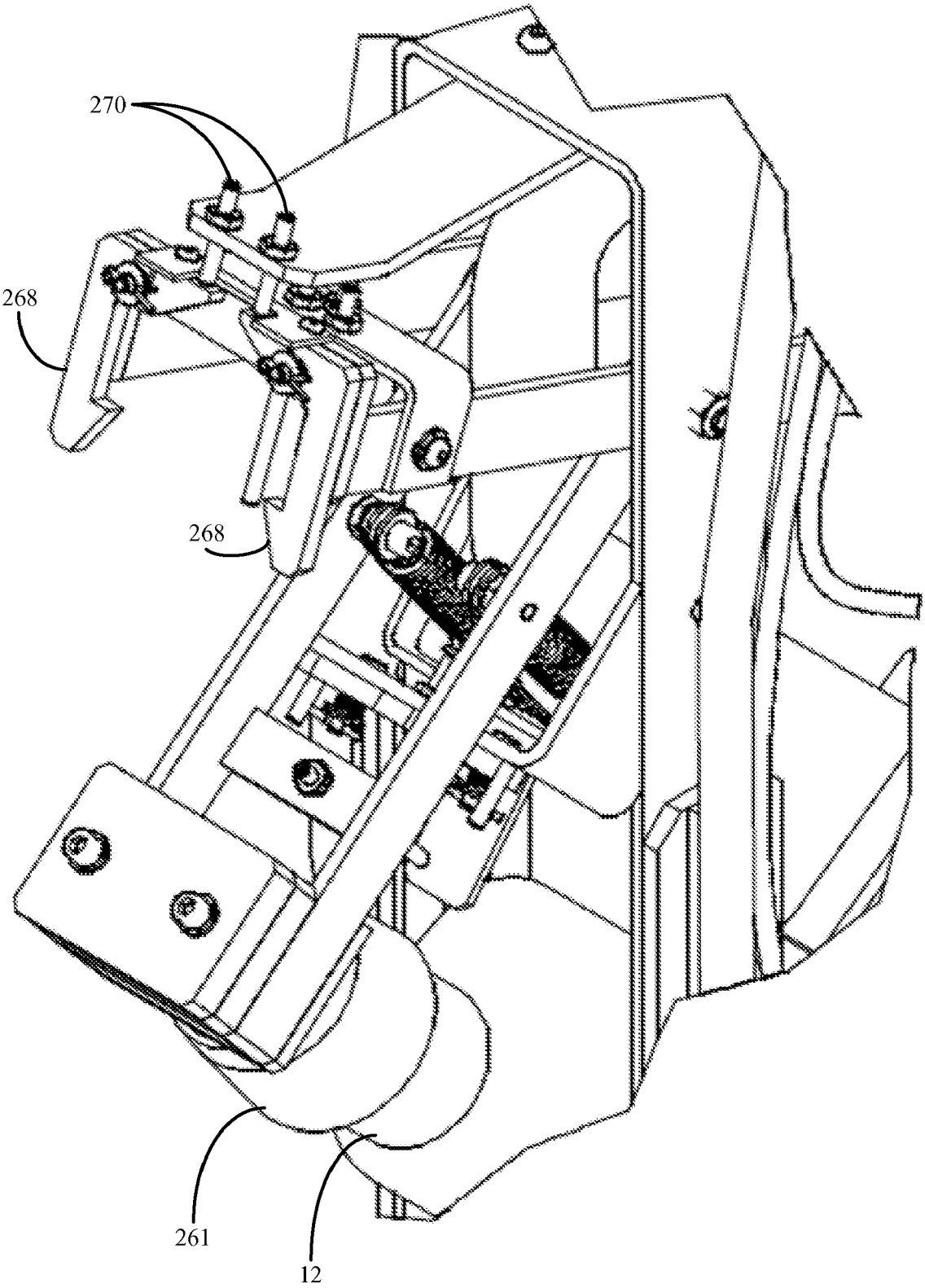
FIG. 16 is a partial perspective view of the securing mechanism shown in FIG. 14, illustrating pivoting grippers and pins of the securing mechanism in greater detail.

FIG. 16 is a partial perspective view of the securing mechanism 206, illustrating the pivoting grippers 268 and the mallet head 261 in greater detail. As shown in FIG. 14, a number of pins 270 may extend from the securing mechanism 206 adjacent the location of the forward end of the transferring arm 264 in the raised position. When the forward end of the transferring arm 264 approaches the raised position, the pins 270 may engage the pivoting grippers 268. The pivoting grippers 268 may pivot outward, releasing the forward end of the receiving arm. The mallet head 261 may descend toward the lowered position, causing the mallet head 261 to apply the activating force to the activating button 12. The floor board nailer 10 may then eject the nail into the floor board 102.

Once the mallet head 261 strikes the activating button 12, the mallet head 261 may come to rest on the activating button 12. Thus, the mallet head 261 may be positioned to be gripped by the pivoting grippers 268 when the activator 259 is next engaged. Alternatively, the momentum of the mallet head 261 may be sufficient to cause the mallet head 261 to bounce up, descend, and apply a second activating force to the activating button 12. In such cases, the system may impede the mallet head 261 from applying the second activating force so that only one fastener is ejected. For example, the securing mechanism 206 may include a limiter that impedes the mallet head 261 from subsequently descending upon the activating button 12 after the initial fastener is ejected.

It should be noted that any component of the securing mechanism 206 may be automated, depending on the embodiment. For example, the cylinder 263 may be a pneumatic cylinder. In such a case, the system 200 may further include an air compressor 260, and the activator 259 may cause compressed air to travel from the air compressor 260 to the cylinder 263 through a pneumatic tube 272. Further, the fastening apparatus 257 may be automated. For example, the floor board nailer 10 may be pneumatically assisted, in which case the activating force of the mallet head 261 may activate a pneumatic mechanism that pneumatically ejects the nail. In such cases, the floor board nailer 10 may be associated with an air compressor 260, and the activating force upon the activating button 12 may cause compressed air to travel from the air compressor to the floor board nailer 10. In embodiments in which more than one of the air hammer 254, the cylinder 263, and floor board nailer 10 are pneumatic, the system 200 may employ a single air compressor 260 that services each of these components. Alternatively, at least some of these components may be manually operated. For example, the floor board nailer 10 may be manual, in which case the activating force of the mallet head 261 may causes a plunger of the floor board nailer 10 to mechanically eject the nail.

It should be noted that the securing mechanism 206 is described by way of example and that a range of other configurations are possible. For example, in embodiments in which the fastening apparatus 257 is activated via the activating button 12, the activating force may be applied to the activating button 12 in a range of manners. More specifically, while the activating force may be applied to the fastening apparatus 257 via the cylinder 263, the mallet head 261, and the transfer assembly 262, in other embodiments, the activating force may be applied in other manners. In such cases, one or more of the cylinder 263, the mallet head 261, and the transfer assembly 262 may be omitted.

So that the fastening apparatus 257 may be employed outside of the system 200, the fastening apparatus 257 may be removable from the support mechanism 208. The support mechanism 208 may include a housing 274, and the fastening apparatus 257 may be removably coupled to a housing 274. For example, the fastening apparatus 257 may be coupled to the housing 274 using one or more removable fasteners, such as bolts, and the housing 274 may be coupled to the support mechanism 208. To remove the fastening apparatus 257 from the system 200, the user may remove the fasteners and may slide the fastening apparatus 257 out of the housing 274. The user may then operate the fastening apparatus 257 apart from the system 200. To associate the fastening apparatus 257 with the system 200, the user may reinsert the fastening apparatus 257 into the housing 274. The housing 274 may serve as a guide to maintain the relative positioning of the fastening apparatus 257 with reference to the other components of the system 200. The user may then secure the fastening apparatus 257 to the housing 274 using the fasteners.

As mentioned above and as shown in FIGS. 5 and 6, the support mechanism 208 may include the shield 218 and the pedal 220. The shield 218 may extend upwardly along a forward side of the support mechanism 208 to form a barrier between the components of the system 200 and the user. For example, the shield 218 may inhibit the user from placing his fingers in the way of moving components of the system 200, such as between the reciprocating arms of the transfer assembly 262. The pedal 220 may permit the user to raise and lower the fastening apparatus 257. For example, the fastening apparatus 257 may be lowered so that the lower surface of the fastening apparatus 257 is in contact with the floor board 102. Thus, the nail may enter the floor board 102 when the fastening apparatus 257 is activated. The fastening apparatus 257 may be raised so that the fastening apparatus 257 is elevated above the floor board 102. Thus, the system 200 may be laterally re-positioned without the fastening apparatus 257 scraping along the floor boards 102.

The operation of the system 200 will now be described. The system 200 may be operated by a standing user. The standing user may move the system 200 into an appropriate position on the sub-floor surface 106. The support mechanism 208 may be moved on the wheels or other transport members 214, so that substantially the entire system 200 is positioned simultaneously. The lowering mechanism 202 may be operated to lower the board 102 onto the sub-floor surface 106. The standing user may engage the actuator 222, such as by rotating the crank 228, to raise the retaining member 224. The linkages 226 may respond by raising the retaining member 224 into the raised position. Once in the raised position, the retaining member 224 may be at a height that is accessible to the standing user. The standing user may insert a board 102 into the access opening 232 of the retaining member 224. The holders 234 of the retaining member 224 may generally retain the board 102. The standing user may engage the actuator 222, such as by rotating the crank 228, to lower the retaining member 224. As the retaining member 224 is lowered, the holders 234 may limit the movement of the board 102 with reference to the retaining member 224 in the vertical direction, so that the board 102 does not free fall. Once the retaining member 224 is in the lowered position proximate to the sub-floor surface 106, the retaining member 224 may be released so that the board 102 falls onto the floor 100. For example, the lever arm 242 on the pivotable holder 238 may engage the kick plate 240 as the retaining member 224 is lowered. The pivotable holder 238 may pivot away from the retaining member 224 so that the board 102 drops onto the floor.

The standing user may then actuate the trigger 244 to operate the positioning component 246, which may respond by applying a force to the board 102. For example, the standing user may rotate the crank 250, and the rotation may be transferred to the plate 252. The plate 252 may push the board 102 against at least the longitudinally adjacent board 104. In some embodiments, the standing user may push the button 256, which may activate the air hammer 254. The air hammer 254 may apply a vibrational force to the positioning plate 252, further causing the plate 252 to push the board 102 against one or both of the longitudinally adjacent board 104 and the transversely adjacent board 104. Both the crank 250 and the button 256 may be at a height that is accessible by the user, so that the user may remain in the standing position while operating the positioning mechanism 204.

Once the board 102 is properly positioned, the securing mechanism 206 may be operated to secure the board 102 to the sub-floor surface 106. The pedal 220 may be engaged to lower the fastening apparatus 257. The standing user may then engage the activator 259 to raise the cylinder 263. The cylinder 263 may cause the transfer assembly 262 to lower the pivoting grippers 268. The pivoting grippers 268 may grasp the mallet head 261. The standing user may disengage the activator 259 to lower the cylinder 263. The cylinder 263 may cause the transfer assembly 262 to raise the pivoting grippers 268, and therefore, the mallet head 261. The pins 270 may contact the pivoting grippers 268, causing the pivoting grippers 268 to pivot outward. The mallet head 261 may be released by the pivoting grippers 268, descending toward the activating button 12 on the floor board nailer 10. The mallet head 261 may apply the activating force to the activating button 12, so that the floor board nailer 10 ejects the nail into the floor board 102. The shield 218 may protect the user as the mallet head 261 drops. The pedal 220 may then be disengaged, raising the fastening apparatus 257. The standing user may move the support mechanism 208 on the wheels or other transport members 214 to reposition substantially the entire system 200 simultaneously. The securing mechanism 206 may again be operated to secure the board 102. Once the board 102 is adequately secured, the process may be repeated to install another floor board.

Although the system 200 is described with reference to floor boards 102 such as hardwood floor boards, a person of skill will appreciate that the system 200 is not limited to any particular flooring surface. The system may be employed to install a wide range of other flooring surfaces made from a range of materials, whether now known or subsequently developed.

While particular embodiments of systems for installing floor boards have been disclosed in detail in the foregoing description and figures for purposes of example, those skilled in the art will understand that variations and modifications may be made without departing from the scope of the disclosure. All such variations and modifications are intended to be included within the scope of the present disclosure, as protected by the following claims.

At least the following is claimed:

1. A system for installing a floor above a sub-floor surface, the floor having a board abutting adjacent boards, the system comprising:

a lowering apparatus adapted to receive the board and to lower the board to the floor;

a positioning apparatus adapted to position the board in contact with one or more of the adjacent boards, comprising:

a crank at least one linkage operatively coupled to the crank, the linkage rotating in plane that is substantially parallel to the floor in response to rotation of the crank; and a positioning plate positioned on the linkage, the linkage transferring rotation of the crank to the positioning plate so that the positioning plate contacts and applies a force to the board; and a securing apparatus adapted to secure the board to the sub-floor surface.

2. The system of claim 1, wherein the lowering apparatus comprises:

an actuator;

a retaining member sized and shaped to receive the board and to limit movement of the board in a vertical direction; and one or more linkages operatively coupling the actuator to the retaining member, the one or more linkages transferring movement of the actuator to the retaining member to raise and lower the retaining member.

3. The system of claim 2, wherein the retaining member comprises:

an access opening sized and shaped to permit inserting the board into the retaining member; and one or more holding brackets sized and shaped to limit movement of the board in the vertical direction.

4. The system of claim 1, further comprising an air compressor, wherein one or more of the lowering apparatus, the positioning apparatus, and the securing apparatus are pneumatically powered using the air compressor.

5. The system of claim 1, wherein the securing apparatus comprises:

an activator; and a floor board fastening device operatively coupled to the activator, the floor board fastening device ejecting a fastener in response to engagement of the activator.

6. The system of claim 1, further comprising a movable cart associated with the lowering apparatus, the positioning apparatus, and the securing apparatus, such that substantially the entire system is repositioned upon moving the movable cart.

7. A system, for installing a floor above a sub-floor surface, the floor having a board abutting adjacent boards, the system comprising:

a lowering apparatus adapted to receive the board and to lower the board to the floor;

a positioning apparatus adapted to position the board in contact with one or more of the adjacent boards;

a securing apparatus adapted to secure the board to the sub-floor surface, the securing apparatus comprising:

an activator; and a floor board fastening device operatively coupled to the activator, the floor board fastening device ejecting a fastener in response to engagement of the activator, wherein the floor board fastening device ejects the fastener in response to an activating force upon a button of the floor board fastening device:

a mallet head positioned to apply the activating force to the button when the mallet head is released from a raised position;

a transfer assembly configured to grasp the mallet head when the transfer assembly is lowered and to raise the mallet head when the transfer assembly is raised; and a cylinder associated with the activator and the transfer assembly, the cylinder responding to engagement of the activator by lowering and raising the transfer assembly, causing the transfer assembly to grasp and raise the mallet head such that the mallet head can descend to apply the activating force on the button.

8. The system of claim 7 wherein the positioning apparatus comprises:

a trigger; and at least one positioning component operatively coupled to the trigger, the positioning component applying a force to the board in response to engagement of the trigger.

9. The system of claim 8, wherein the at least one positioning component comprises a positioning plate that rotates into contact with the board in response to engagement of the trigger.

10. The system of claim 7, wherein the lowering apparatus comprises:

an actuator;

a retaining member sized and shaped to receive the board and to limit movement of the board in a vertical direction; and one or more linkages operatively coupling the actuator to the retaining member, the one or more linkages transferring movement of the actuator to the retaining member to raise and lower the retaining member.

11. The system of claim 7, further comprising an air compressor, wherein one or more of the lowering apparatus, the positioning apparatus, and the securing apparatus are pneumatically powered using the air compressor.

12. A system for installing a board on a surface, the system comprising:

a positioning plate positioned proximate to the surface;

a trigger operatively coupled to the positioning plate by at least one linkage, the trigger causing the linkage to move the positioning plate into contact with the board wherein the trigger is a crank that rotates about a pivot point in a plane substantially parallel to the surface, and the positioning plate is positioned on the linkage spaced apart from the pivot point of the crank, the linkage transferring rotation of the crank to the positioning plate;

a fastening device positioned proximate to the surface; and an activator operatively coupled to the fastening device, the activator causing the fastening device to eject a fastener into the board.

13. The system of claim 12, wherein:

the fastening device is a floor board nailer that ejects a nail in response to an activating force upon an activating button; and the activator causes a mallet head to apply the activating force to the activating button.

14. The system of claim 12, further comprising:

a holder sized and shaped to receive the floor board and to limit movement of the floor board in a vertical direction;

an actuator that is movable between a first position and a second position; and one or more linkages operatively connecting the actuator to the holder, the one or more linkages raising and lowering the holder in response to movement of the actuator between the first position and the second position.

15. The system of claim 12, further comprising an air compressor operatively associated with the one or more of the fastening device and the positioning plate are pneumatically powered using the air compressor.

16. A system operated by a standing user to install a floor board on a floor, the system comprising:

a retaining member that receives the floor board and is lowered to the floor in response to the standing user engaging a first trigger;

a positioning plate that contacts and applies a force to the floor board in response to the standing user engaging a second trigger;

a fastening device that ejects a fastener through the floor board in response to the standing user engaging a third trigger, the fastening device moving into and out of contact with the floor in response to the standing user engaging a fourth trigger operatively coupled to the fastening device; and a movable can associated with the retaining member, the positioning plate, the fastening device, and each of the triggers, such that moving the movable can simultaneously repositions substantially the entire system.

17. The system of claim 16, wherein:

the first trigger is a first crank, the first crank causing a first linkage to move the retaining member;

the second trigger is a second crank, the second crank causing a second linkage to rotate the positioning plate; and the third trigger is a button, the button causing a mallet head to apply an activating force to the fastening device.

18. The system of claim 16, wherein:

the retaining member is associated with the movable can via a series of linkages, the linkages raising and lowering the retaining member in response to the user engaging the first trigger, the retaining member being accessible to the standing user when raised and being proximate to the floor when lowered; and the first trigger is associated with the movable cart at a height accessible to the standing user, such the when the standing user operates the first trigger at the accessible height, the linkages raise and lower the retaining member.

19. The system of claim 16, wherein:

the positioning plate is associated with the movable cart adjacent to the floor; and the second trigger is associated with the movable cart at an accessible height for the standing user, such that when the standing user operates the second trigger at the accessible height, the positioning plate is moved adjacent to the floor.

20. The system of claim 16, wherein:

the fastening device is associated with the movable cart adjacent to the floor; and the third trigger is associated with the movable cart at an accessible height for the standing user, such that when the standing user operates the third trigger at the accessible height, the fastening device ejects the fastener adjacent to the floor.

21. The system of claim 16, further comprising an air compressor, wherein one or both of the fastening device and the positioning plate are pneumatically powered using the air compressor.

* * * * *